US010294065B2

(12) United States Patent
Gelmetti

(10) Patent No.: US 10,294,065 B2
(45) Date of Patent: May 21, 2019

(54) RETAINER FOR A WELDING WIRE CONTAINER AND WELDING WIRE CONTAINER

(71) Applicant: SIDERGAS SPA, S. Ambrogio di Valpolicella (IT)

(72) Inventor: Carlo Gelmetti, Lazise (IT)

(73) Assignee: SIDERGAS SPA (IT)

( * ) Notice: Subject to any disclaimer, the term of this patent is extended or adjusted under 35 U.S.C. 154(b) by 195 days.

(21) Appl. No.: 13/912,016

(22) Filed: Jun. 6, 2013

(65) Prior Publication Data

US 2014/0361115 A1 Dec. 11, 2014

(51) Int. Cl.

| | |
|---|---|
| ***B65H 59/08*** | (2006.01) |
| ***B65H 49/08*** | (2006.01) |
| ***B65H 57/18*** | (2006.01) |
| ***B65H 49/04*** | (2006.01) |
| ***B65H 49/38*** | (2006.01) |

(52) U.S. Cl.

CPC ..... *B65H 59/08* (2013.01); *B65H 49/04* (2013.01); *B65H 49/08* (2013.01); *B65H 49/38* (2013.01); *B65H 57/18* (2013.01); *B65H 2701/36* (2013.01)

(58) Field of Classification Search

CPC ..... B65H 59/08; B65H 49/38; B65H 49/04; B65H 49/08; B65H 57/18; B65H 2701/36

USPC ..... 242/423, 423.1, 156, 156.1, 156.2, 566, 242/593, 128, 125.3, 172, 419, 157 R

See application file for complete search history.

(56) References Cited

U.S. PATENT DOCUMENTS

| | | | | |
|---|---|---|---|---|
| RE8,148 | E | 4/1878 | Meinikheim | 220/485 |
| 318,062 | A | 5/1885 | Warren | |
| 532,565 | A | 1/1895 | Kilmer | |
| 617,353 | A | 1/1899 | Redmond | |
| 627,722 | A | 6/1899 | Edwards | |
| 932,808 | A | 8/1909 | Pelton | |
| 1,276,117 | A | 8/1918 | Riebe | 464/171 |
| 1,468,994 | A | 9/1923 | Cook | 206/393 |
| 1,508,689 | A | 9/1924 | Glasser | 219/124.03 |
| 1,640,368 | A | 8/1927 | Obetz | |

(Continued)

FOREIGN PATENT DOCUMENTS

| | | | |
|---|---|---|---|
| DE | 152978 | 8/1903 | |
| DE | 202011104120 | 1/2012 | B23K 9/133 |

(Continued)

OTHER PUBLICATIONS

MatWeb Data Sheet: "Universal Wire Works 4043 (AMS 4190) Aluminum Alloy Filler Metal".*

(Continued)

*Primary Examiner* — Michael R Mansen
*Assistant Examiner* — Nathaniel L Adams
(74) *Attorney, Agent, or Firm* — Hayes Soloway P.C.

(57) ABSTRACT

A retainer is described for exerting a braking effect on wire provided as a spool in a container. The retainer has a plate-like elastic element with a contact surface adapted for resting on the wire, an outer circumference adapted for being guided in the container, and an inner circumference adapted for allowing the wire to pass through. The plate-like elastic element has an elasticity such that one of the inner and outer circumferences sags down, under the proper weight of the retainer, by a distance of at least 10 mm when the retainer is supported at the other of the inner and outer circumference.

16 Claims, 3 Drawing Sheets

(56) References Cited

U.S. PATENT DOCUMENTS 1,821,354 A 9/1931 Meyer ..... 242/159
1,907,051 A 5/1933 Emery
1,936,227 A 11/1933 Cook ..... 206/59
2,027,670 A 1/1936 Broeren ..... 312/62
2,027,674 A 1/1936 Broeren ..... 312/60
2,059,462 A 11/1936 Jungmann
2,260,230 A 10/1941 Olson ..... 229/119
2,319,628 A 5/1943 Pinniger ..... 220/485
2,329,369 A 9/1943 Haver ..... 285/11
2,366,101 A 12/1944 Grothey ..... 66/125 R
2,407,746 A 9/1946 Johnson
2,457,910 A 1/1949 McLaren et al. ..... 74/501
2,477,059 A 7/1949 Hill ..... 242/137.1
2,483,760 A 10/1949 Duncan ..... 254/190
2,579,131 A 12/1951 Tinsley ..... 206/409
2,580,900 A 1/1952 Epstein ..... 206/409
2,679,571 A 5/1954 Chappel ..... 219/137.44
2,694,130 A 11/1954 Howard ..... 219/8
2,713,938 A 7/1955 Snyder
2,724,538 A 11/1955 Schweich
2,752,108 A 6/1956 Richardson ..... 242/128
2,838,922 A 6/1958 Gift ..... 66/125 R
2,849,195 A 8/1958 Richardson
2,864,565 A 12/1958 Whearly ..... 242/128
2,869,719 A 1/1959 Hubbard
2,880,305 A 3/1959 Baird
2,911,166 A 11/1959 Haugwitz ..... 242/128
2,929,576 A 3/1960 Henning
2,966,258 A 12/1960 Krafft
2,974,850 A 3/1961 Mayer
2,984,596 A 5/1961 Franer ..... 206/412
3,022,415 A 2/1962 Francois ..... 219/137.44
3,028,066 A 4/1962 Bumby ..... 220/23.9
3,096,951 A 7/1963 Jenson ..... 242/137.1
3,108,180 A 10/1963 Linnander ..... 219/137.44
3,119,042 A 1/1964 Bond
3,185,185 A 5/1965 Pfund
3,244,347 A 4/1966 Jenk
3,274,850 A 9/1966 Tascio ..... 74/501
3,283,121 A 11/1966 Bernard et al. ..... 219/137.44
3,284,608 A 11/1966 McDonald ..... 219/137.43
3,344,682 A 10/1967 Bratz ..... 74/501
3,352,412 A 11/1967 Draving et al. ..... 206/59
3,377,388 A 4/1968 Hsu et al. ..... 206/389
3,433,504 A 3/1969 Hanes ..... 285/93
3,463,416 A 8/1969 Quenot ..... 242/396.9
3,478,435 A 11/1969 Cook
3,491,876 A 1/1970 Zecchin
3,512,635 A 5/1970 Lang
3,536,888 A 10/1970 Borneman ..... 219/137.43
3,565,129 A 2/1971 Field
3,567,900 A 3/1971 Nelson
3,576,966 A 5/1971 Sullivan
3,595,277 A 7/1971 Lefever
3,648,920 A 3/1972 Stump
3,659,737 A 5/1972 Garbe ..... 217/12 R
3,690,567 A 9/1972 Borneman ..... 239/591
3,724,249 A 4/1973 Asbeck et al.
3,729,092 A 4/1973 Marcell
3,730,136 A 5/1973 Okada ..... 118/78
3,799,215 A 3/1974 Willems
3,815,842 A 6/1974 Scrogin ..... 242/423.1
3,823,894 A 7/1974 Frederick et al. ..... 242/137.1
3,939,978 A 2/1976 Thomaswick ..... 206/454
3,958,712 A 5/1976 Martin ..... 217/40
4,000,797 A 1/1977 Ducanis ..... 193/38
4,043,331 A 8/1977 Martin et al. ..... 128/156
4,044,583 A 8/1977 Kinney, Jr.
4,074,105 A 2/1978 Minehisa et al.
4,097,004 A 6/1978 Reese ..... 242/129
4,102,483 A 7/1978 Ueyama et al.
4,113,795 A 9/1978 Izawa et al. ..... 524/84
4,127,590 A 11/1978 Endo et al. ..... 260/346.74
4,157,436 A 6/1979 Endo et al. ..... 528/167
4,161,248 A 7/1979 Kalmanovitch ..... 206/389
4,171,783 A 10/1979 Waltemath ..... 242/128
4,172,375 A 10/1979 Rushforth et al.
4,188,526 A 2/1980 Asano
4,222,535 A 9/1980 Hosbein ..... 242/128
4,254,322 A 3/1981 Asano
4,274,607 A 6/1981 Priest ..... 242/163
4,280,951 A 7/1981 Saito et al. ..... 524/118
4,293,103 A 10/1981 Tsukamoto
4,354,487 A 10/1982 Oczkowski et al. ..... 604/366
4,392,606 A 7/1983 Fremion ..... 206/600
4,396,797 A 8/1983 Sakuragi et al. ..... 174/68
4,429,001 A 1/1984 Kolpin et al. ..... 442/340
4,451,014 A 5/1984 Kitt et al. ..... 242/128
4,464,919 A 8/1984 Labbe
4,500,315 A 2/1985 Pieniak et al. ..... 604/379
4,516,692 A 5/1985 Croley ..... 222/105
4,540,225 A 9/1985 Johnson et al. ..... 439/192
4,546,631 A 10/1985 Eisinger
4,575,612 A 3/1986 Prunier ..... 219/137.43
4,582,198 A 4/1986 Ditton
4,585,487 A 4/1986 Destree et al.
4,623,063 A 11/1986 Balkin
4,737,567 A 4/1988 Matsumoto et al. ..... 528/167
4,742,088 A 5/1988 Kim ..... 521/118
4,795,057 A 1/1989 Jungels et al. ..... 206/386
4,826,497 A 5/1989 Marcus et al. ..... 604/359
4,855,179 A 8/1989 Bourland et al. ..... 442/409
4,869,367 A 9/1989 Kawasaki et al. ..... 206/409
4,891,493 A 1/1990 Sato et al. ..... 219/137
4,916,282 A 4/1990 Chamming et al. ..... 219/69.2
4,918,286 A 4/1990 Boyer ..... 219/137.44
4,949,567 A 8/1990 Corbin ..... 72/164
4,974,789 A 12/1990 Milburn ..... 242/159
5,051,539 A 9/1991 Leathers-Wiessner ..... 174/15.7
5,061,259 A 10/1991 Goldman et al. ..... 604/368
5,078,269 A 1/1992 Dekko et al. ..... 206/397
5,097,951 A 3/1992 Pigott ..... 206/397
5,100,397 A 3/1992 Poccia et al. ..... 604/365
5,105,943 A 4/1992 Lesko et al. ..... 206/397
5,109,983 A 5/1992 Malone et al. ..... 206/408
5,147,646 A 9/1992 Graham ..... 424/424
5,165,217 A 11/1992 Sobel et al. ..... 242/159
5,201,419 A 4/1993 Hayes ..... 206/409
5,205,412 A 4/1993 Krieg ..... 206/394
5,215,338 A 6/1993 Kimura et al. ..... 285/166
5,227,314 A 7/1993 Brown et al. ..... 437/10
5,261,625 A 11/1993 Lanoue ..... 242/129.8
5,277,314 A 1/1994 Cooper et al. ..... 206/398
5,279,441 A 1/1994 Featherall ..... 220/485
5,314,111 A 5/1994 Takaku et al. ..... 229/110
5,368,245 A 11/1994 Fore ..... 242/171
5,372,269 A 12/1994 Sutton et al. ..... 220/62
5,452,841 A 9/1995 Sibata et al. ..... 228/180.5
5,485,968 A 1/1996 Fujioka ..... 242/172
5,494,160 A 2/1996 Gelmetti ..... 206/395
5,530,088 A 6/1996 Sheen et al. ..... 528/287
5,553,810 A 9/1996 Bobeczko ..... 242/601
5,562,646 A 10/1996 Goldman et al. ..... 604/368
5,585,013 A 12/1996 Truty ..... 219/69.12
5,586,733 A 12/1996 Miura et al. ..... 242/125.2
5,590,848 A 1/1997 Shore et al. ..... 242/361
5,629,377 A 5/1997 Burgert et al. ..... 524/832
5,645,185 A 7/1997 Cassina ..... 220/1.5
5,665,801 A 9/1997 Chang et al. ..... 524/125
5,692,700 A 12/1997 Bobeczko ..... 242/588.2
5,702,001 A 12/1997 Russell et al. ..... 206/388
5,714,156 A 2/1998 Schmidt et al. ..... 424/404
5,738,209 A 4/1998 Burr et al. ..... 206/397
5,739,704 A 4/1998 Clark ..... 326/62
5,746,380 A 5/1998 Chung ..... 242/171
5,758,834 A 6/1998 Dragoo et al. ..... 242/128
5,778,939 A 7/1998 Hok-Yin ..... 138/120
5,816,466 A 10/1998 Seufer ..... 226/187
5,819,934 A 10/1998 Cooper ..... 206/397
5,845,862 A 12/1998 Cipriani ..... 242/423.1
5,847,184 A 12/1998 Kleiner ..... 558/73
5,865,051 A 2/1999 Otzen et al. ..... 72/17.3
5,921,391 A 7/1999 Ortiz et al. ..... 206/397
5,931,408 A 8/1999 Ishii et al. ..... 242/580

(56) References Cited

U.S. PATENT DOCUMENTS

| | | | | |
|---|---|---|---|---|
| 5,971,308 | A | 10/1999 | Boulton | 242/131 |
| 5,988,370 | A | 11/1999 | Roemer et al. | 206/215 |
| 5,990,377 | A | 11/1999 | Chen et al. | 604/381 |
| 6,016,911 | A | 1/2000 | Chen | 200/395 |
| 6,019,303 | A | 2/2000 | Cooper | 424/361.4 |
| 6,103,358 | A | 8/2000 | Bruggemann et al. | 428/317.9 |
| 6,159,591 | A | 12/2000 | Beihoffer et al. | 428/327 |
| 6,237,768 | B1 | 5/2001 | Cipriani | 206/408 |
| 6,245,880 | B1 | 6/2001 | Takeuchi et al. | 528/287 |
| 6,255,371 | B1 | 7/2001 | Schlosser et al. | 524/100 |
| 6,260,781 | B1 | 7/2001 | Cooper | 424/361.4 |
| 6,301,944 | B1 | 10/2001 | Offer | 72/79 |
| 6,322,016 | B1 | 11/2001 | Jacobsson et al. | 424/356.4 |
| 6,340,522 | B1 | 1/2002 | Burke et al. | 428/359 |
| 6,408,888 | B1 | 6/2002 | Baeumer et al. | 138/120 |
| 6,409,116 | B1 | 6/2002 | Brown | 242/419.1 |
| 6,417,425 | B1 | 7/2002 | Whitmore et al. | 604/367 |
| 6,425,549 | B1 | 7/2002 | Bae et al. | 242/580 |
| 6,464,077 | B1 | 10/2002 | Liu | 206/388 |
| 6,481,892 | B1 | 11/2002 | Agostini | 384/43 |
| 6,498,227 | B1 | 12/2002 | Horie | 528/176 |
| 6,524,010 | B1 | 2/2003 | Derman | 384/513 |
| 6,547,176 | B1 | 4/2003 | Blain et al. | 242/423.1 |
| 6,564,943 | B2 | 5/2003 | Barton et al. | 206/395 |
| 6,613,848 | B1 | 9/2003 | Wang et al. | 525/481 |
| 6,636,776 | B1 | 10/2003 | Barton et al. | 700/169 |
| 6,648,141 | B2 | 11/2003 | Land | 206/408 |
| 6,649,870 | B1 | 11/2003 | Barton et al. | 219/137 |
| 6,708,864 | B2 | 3/2004 | Ferguson, III et al. | 228/56.3 |
| 6,715,608 | B1 | 4/2004 | Moore | 206/397 |
| 6,745,899 | B1 | 6/2004 | Barton | 206/409 |
| 6,749,136 | B1 | 6/2004 | Speck | |
| 6,750,262 | B1 | 6/2004 | Hahnle et al. | 521/64 |
| 6,753,454 | B1 | 6/2004 | Smith et al. | 602/41 |
| 6,821,454 | B2 | 11/2004 | Visca et al. | 34/341 |
| 6,831,142 | B2 | 12/2004 | Mertens et al. | 526/328.5 |
| 6,872,275 | B2 | 3/2005 | Ko et al. | 156/181 |
| 6,889,835 | B2 | 5/2005 | Land | 206/408 |
| 6,913,145 | B2 | 7/2005 | Barton | 206/409 |
| 6,938,767 | B2 | 9/2005 | Gelmetti | 206/408 |
| 6,977,357 | B2 | 12/2005 | Hsu et al. | 219/130.01 |
| 7,004,318 | B2 | 2/2006 | Barton | 206/409 |
| 7,108,916 | B2 | 9/2006 | Ehrnsperger et al. | 428/403 |
| 7,147,176 | B2 | 12/2006 | Rexhaj | 242/417.3 |
| 7,152,735 | B2 | 12/2006 | Dragoo et al. | 206/408 |
| 7,156,334 | B1 | 1/2007 | Fore et al. | 242/171 |
| 7,178,755 | B2 | 2/2007 | Hsu et al. | 242/423.1 |
| 7,198,152 | B2 | 4/2007 | Barton et al. | 206/409 |
| 7,220,942 | B2 | 5/2007 | Barton et al. | 219/137.7 |
| 7,309,038 | B2 | 12/2007 | Carroscia | 206/409 |
| RE40,351 | E | 6/2008 | Cipriani | 242/423.1 |
| 7,398,881 | B2 | 7/2008 | Barton et al. | 206/408 |
| 7,410,111 | B2 * | 8/2008 | Carroscia | 242/171 |
| 7,441,657 | B2 | 10/2008 | Gelmetti | 206/393 |
| 7,441,721 | B2 | 10/2008 | Bae et al. | 242/128 |
| 7,533,906 | B2 | 5/2009 | Luettgen et al. | 285/146.1 |
| 7,563,840 | B2 | 7/2009 | Ye | 524/449 |
| 7,748,530 | B2 | 7/2010 | Hsu et al. | 406/408 |
| 7,950,523 | B2 | 5/2011 | Gelmetti | 206/408 |
| 8,207,475 | B2 | 6/2012 | Minato et al. | 219/137.31 |
| 8,235,210 | B2 | 8/2012 | De Lacerda et al. | 206/393 |
| 8,882,018 | B2 | 11/2014 | Gelmetti | 242/128 |
| 2001/0014706 | A1 | 8/2001 | Sprenger et al. | 523/400 |
| 2002/0000391 | A1 | 1/2002 | Kawasai et al. | 206/408 |
| 2002/0003014 | A1 | 1/2002 | Homma | |
| 2002/0014477 | A1 | 2/2002 | Lee et al. | |
| 2002/0039869 | A1 | 4/2002 | Achille | 442/417 |
| 2002/0120178 | A1 | 8/2002 | Tartaglia et al. | 600/114 |
| 2003/0006235 | A1 | 1/2003 | Przytulla | 220/485 |
| 2003/0042162 | A1 | 3/2003 | Land | 206/408 |
| 2003/0042163 | A1 | 3/2003 | Cipriant | |
| 2003/0052030 | A1 | 3/2003 | Gelmetti | 206/397 |
| 2003/0184086 | A1 | 10/2003 | Christianson | 285/146.1 |
| 2004/0020041 | A1 | 2/2004 | Ferguson, III et al. | |
| 2004/0050441 | A1 | 3/2004 | Roschi | 138/120 |
| 2004/0133176 | A1 | 7/2004 | Muthiah et al. | 604/368 |
| 2004/0155090 | A1 | 8/2004 | B.-Jensen | |
| 2004/0176557 | A1 | 9/2004 | Mertens et al. | 526/328.5 |
| 2004/0186244 | A1 | 9/2004 | Hatsuda et al. | 525/451 |
| 2004/0201117 | A1 | 10/2004 | Anderson | 264/4.3 |
| 2004/0241333 | A1 | 12/2004 | Cielenski et al. | 427/421.1 |
| 2004/0265387 | A1 | 12/2004 | Hermeling et al. | 424/486 |
| 2005/0008776 | A1 | 1/2005 | Chhabra et al. | 427/180 |
| 2005/0023392 | A1 | 2/2005 | Hsu et al. | 242/171 |
| 2005/0258290 | A1 | 11/2005 | Kuper | 242/171 |
| 2005/0261461 | A1 | 11/2005 | Maeda et al. | 528/272 |
| 2006/0027699 | A1 | 2/2006 | Bae et al. | |
| 2006/0074154 | A1 | 4/2006 | Harashina et al. | 524/115 |
| 2006/0155254 | A1 | 7/2006 | Sanz et al. | 604/378 |
| 2006/0196794 | A1 | 9/2006 | Nicklas | 206/389 |
| 2006/0247343 | A1 | 11/2006 | Kishimoto et al. | 524/117 |
| 2006/0258824 | A1 | 11/2006 | Oshima et al. | 525/533 |
| 2006/0278747 | A1 | 12/2006 | Carroscia | |
| 2007/0045141 | A1 | 3/2007 | Gelmetti | 206/409 |
| 2007/0056943 | A1 | 3/2007 | Tenbrink | 219/130.01 |
| 2007/0175786 | A1 | 8/2007 | Nicklas | |
| 2007/0175965 | A1 | 8/2007 | Carroscia | 228/4.5 |
| 2007/0272573 | A1 | 11/2007 | Gelmetti | |
| 2007/0284354 | A1 | 12/2007 | Laymon | 219/137.51 |
| 2008/0156925 | A1 | 7/2008 | Cooper | 242/559.3 |
| 2008/0257875 | A1 | 10/2008 | De Keizer | 219/137.44 |
| 2008/0300349 | A1 | 12/2008 | Fuchikami et al. | 524/117 |
| 2008/0314876 | A1 | 12/2008 | Pinsonneault et al. | 219/74 |
| 2009/0014572 | A1 | 1/2009 | Weissbrod et al. | |
| 2009/0014579 | A1 | 1/2009 | Bender et al. | |
| 2009/0107867 | A1 * | 4/2009 | Bang | B65H 57/18 206/408 |
| 2009/0200284 | A1 | 8/2009 | Sanchez | 219/137.51 |
| 2010/0116803 | A1 | 5/2010 | Gelmetti | 219/138 |
| 2011/0073703 | A1 | 3/2011 | Gelmetti et al. | 242/615.2 |
| 2011/0094911 | A1 | 4/2011 | Gelmetti | 206/408 |
| 2011/0114523 | A1 | 5/2011 | Gelmetti | 206/407 |
| 2011/0114617 | A1 | 5/2011 | Gelmetti et al. | 219/137.9 |
| 2011/0132880 | A1 | 6/2011 | Kossowan | 219/46.14 |
| 2012/0006802 | A1 | 1/2012 | Bae | 219/136 |
| 2012/0298630 | A1 | 11/2012 | Stoutamire | 219/75 |
| 2013/0193259 | A1 | 8/2013 | Weissbrod et al. | 242/566 |

FOREIGN PATENT DOCUMENTS

| | | | |
|---|---|---|---|
| EP | 0017445 | 10/1980 | B65H 59/10 |
| EP | 0408259 | 4/1992 | |
| EP | 0519424 A1 | 12/1992 | B23K 9/1333 |
| EP | 2 264 482 | 9/1993 | |
| EP | 0665 166 | 1/1995 | B65D 5/44 |
| EP | 0686439 A1 | 12/1995 | B21C 47/14 |
| EP | 1057751 A1 | 12/2000 | |
| EP | 1 275 595 | 1/2003 | B65D 85/04 |
| EP | 1 295 813 | 3/2003 | B65D 85/04 |
| EP | 1357059 | 10/2003 | B65D 85/04 |
| EP | 1 471 024 | 10/2004 | B65H 49/08 |
| EP | 1 698 421 | 6/2006 | B23K 9/133 |
| EP | 1932613 | 6/2008 | B23K 9/133 |
| EP | 1 504 841 | 2/2009 | B23K 9/133 |
| EP | 2 256 064 | 1/2010 | B65H 49/08 |
| EP | 2 354 039 | 1/2010 | B65D 85/04 |
| EP | 2 168 706 | 3/2010 | B23K 9/133 |
| EP | 2484476 | 8/2012 | B23K 9/32 |
| EP | 2695696 | 2/2014 | B23K 9/12 |
| EP | 2933202 | 10/2015 | |
| GB | 880502 | 10/1961 | B21C 47/14 |
| GB | 1168928 | 10/1969 | D07B 7/10 |
| GB | 1229913 | 4/1971 | B21C 47/14 |
| GB | 1 575 157 | 9/1980 | C09K 21/12 |
| GB | 2059462 | 4/1981 | A23G 3/02 |
| GB | 2 332 451 | 6/1999 | B65H 57/18 |
| JP | H05112352 | 5/1993 | B65D 5/44 |
| WO | WO 81/03319 | 11/1981 | B65D 25/52 |
| WO | WO 8810230 | 12/1988 | B65H 49/08 |
| WO | WO 94-00493 | 1/1994 | A61K 39/00 |
| WO | WO 94-19258 | 9/1994 | B65D 5/10 |
| WO | WO 97/00878 | 1/1997 | C07F 9/6571 |
| WO | WO 98/52844 | 11/1998 | B65D 85/04 |
| WO | WO 00-50197 | 8/2000 | B23C 19/00 |

(56) References Cited

FOREIGN PATENT DOCUMENTS

| | | | |
|---|---|---|---|
| WO | WO 01/27365 | 4/2001 | D01H 4/28 |
| WO | WO 02/094493 | 11/2002 | |
| WO | WO 03-106096 A1 | 12/2003 | B21C 47/20 |
| WO | WO 2005/005704 | 1/2005 | D04H 13/02 |
| WO | WO 2005/061168 | 7/2005 | |
| WO | 2006091075 | 8/2006 | B23K 9/133 |
| WO | WO 2007/010171 | 1/2007 | B65H 57/00 |
| WO | WO 2007/112972 | 10/2007 | B23K 9/133 |
| WO | WO 2007/149689 | 12/2007 | B65H 57/18 |
| WO | WO 2009/007845 | 1/2009 | B23K 9/133 |
| WO | WO2009027784 | 3/2009 | B23K 9/133 |
| WO | WO 2009/143917 | 12/2009 | B65H 57/14 |
| WO | WO 2011/147565 | 12/2011 | B23K 9/133 |
| WO | WO 2013/092658 | 6/2013 | B65H 57/18 |

OTHER PUBLICATIONS

English Translation of KR 2004-0059894.*
U.S. Appl. No. 10/526,539, filed Mar. 3, 2005.
U.S. Appl. No. 10/596,697, filed Jun. 21, 2006.
U.S. Appl. No. 11/466,048, filed Aug. 21, 2006.
U.S. Appl. No. 12/545,717, filed Aug. 21, 2009.
U.S. Appl. No. 12/545,720, filed Aug. 21, 2009.
U.S. Appl. No. 12/593,271, filed Sep. 25, 2009.
U.S. Appl. No. 12/572,994, filed Oct. 2, 2009.
U.S. Appl. No. 12/618,165, filed Nov. 13, 2009.
U.S. Appl. No. 12/618,250, filed Nov. 13, 2009.
U.S. Appl. No. 12/691,554, filed Jan. 21, 2010.
U.S. Appl. No. 12/789,095, filed May 27, 2010.
U.S. Appl. No. 12/994,686, filed Nov. 24, 2010.
U.S. Appl. No. 13/330,314, filed Dec. 19, 2011.
U.S. Appl. No. 13/382,491, filed Jan. 5, 2012.
U.S. Appl. No. 13/744,394, filed Jan. 17, 2013.
U.S. Appl. No. 14/030,879, filed Sep. 18, 2013.
U.S. Appl. No. 14/195,497, filed Mar. 3, 2014.
U.S. Appl. No. 14/289,090, filed May 28, 2014.
U.S. Appl. No. 13/330,314, filed Dec. 19, 2011, Gelmetti.
U.S. Appl. No. 13/744,394, filed Jan. 17, 2013, Gelmetti et al.
U.S. Appl. No. 14/030,879, filed Sep. 18, 2013, Gelmetti.
U.S. Appl. No. 14/195,497, filed Mar. 3, 2014, Gelmetti et al.
U.S. Appl. No. 14/289,090, filed May 28, 2014, Gelmetti et al.
Office Action issued in related U.S. Appl. No 13/330,314, dated Jun. 20, 2014 (14 pgs).
Notice of Allowance issued in related U.S. Appl. No. 13/330,314, dated Sep. 11, 2014 (17 pgs).
Extended European Search Report issued in corresponding European application No. 14169341.6-1705 dated Oct. 10, 2014 (9 pgs).
U.S. Appl. No. 12/572,994, filed Oct. 2, 2009, Gelmetti.
U.S. Appl. No. 13/382,491, filed Jan. 5, 2012, Gelmetti et al.
U.S. Office Action issued in related U.S. Appl. No. 12/572,994, dated Sep. 17, 2013 (13 pgs).
U.S. Appl. No. 13/912,016, filed Jun. 6, 2013.
U.S. Appl. No. 14/679,768, filed Apr. 6, 2015.
U.S. Appl. No. 13/912,016, filed Jun. 6, 2013, Gelmetti.
U.S. Appl. No. 14/679,768, filed Apr. 6, 2015, Gelmetti et al.
Office Action issued in related U.S. Appl. No. 14/030,879, dated Dec. 1, 2014 (38 pgs).
Extended European Search Report issued in related application No. 13179908.2, dated Nov. 13, 2013 (6 pgs).
Office Action issued in related U.S. Appl. No. 13/330,314, dated Feb. 28, 2014 (10 pgs).
European Office Action issued in application No. 16180212.9, dated Jan. 19, 2017 (7 pgs).
Office Action issued in U.S. Appl. No. 13/912,016, dated Sep. 22, 2016 (13 pgs).
Office Action issued in U.S. Appl. No. 14/850,753, dated Aug. 25, 2017 (64 pgs).
Office Action issued in U.S. Appl. No. 14/195,497, dated Mar. 23, 2017 (24 pgs).
European Search Report issued in application No. 17191662.0, dated Mar. 5, 2018 (8 pgs).
Notice of Allowance issued in U.S. Appl. No. 14/850,753, dated Mar. 27, 2018 (14 pgs).
Notice of Allowance issued in U.S. Appl. No. 15/295,797, dated Feb. 13, 2018 (18 pgs).
Office Action issued in U.S. Appl. No. 15/295,797, dated Mar. 5, 2018 (9 pgs).
Notice of Allowance issued in U.S. Appl. No. 14/850,753, dated Jan. 19, 2018 (14 pgs).
Office Action issued in U.S. Appl. No. 15/295,797, dated Dec. 14, 2017 (57 pgs).

* cited by examiner

RETAINER FOR A WELDING WIRE CONTAINER AND WELDING WIRE CONTAINER

The invention relates to a retainer for a welding wire container and to a welding wire container.

BACKGROUND OF THE INVENTION

The use of bulk polygonal packs or round drums containing large quantities of reverse wound aluminium welding wire (in some cases up to as much as 500 kgs) is becoming increasingly popular since it offers the advantage of great savings thanks to a reduced pack changeover downtime and a higher productivity. The ability to avoid unwanted weld interruptions in some applications like the production of vehicle components and automotive parts, is extremely important because stoppages in the middle of the automated weld process can cause cracks, weld defects, mechanical failures with consequent costly aftermarket product liability issues. A good weld with no defects or imperfections is absolutely necessary in order to prevent subsequent equipment failures.

Unwanted production interruptions can offset the advantages of the so-called "lean manufacturing process" that relies on the optimization of the supply flow in sequential steps of production.

The industry today, and in particular the automotive industry, is increasingly using aluminium welding wires for many applications, since aluminium has the advantage of being a resistant, fairly strong, corrosion-free metal but also much lighter (approximately three times lighter) than steel; vehicles with less weight bring relevant fuel savings.

More and more manufacturers are choosing bulk containers with large quantities of twist-free reverse wound welding wire in combination with high performing low friction guiding liners with rolling elements inside.

Aluminium wires are however very soft and can easily be deformed by friction or attrition in particular when the wire during payout is forced to scratch against the inner edge of the wire retainer. Deformed wires can cause serious weld defects that would either require repair where possible, or in the worst case scenario, the inevitable scrapping of valued parts because of their non conformance to the desired quality standards.

This problem has been known for a while and several prior art attempts have been made to solve it.

Barton and Carroscia in U.S. Pat. No. 7,398,881 propose a rigid retainer ring with embedded pockets of different shape and density in order to help reduce the overall retainer weight. The attempt to generate some weight relief is obvious but notwithstanding the pockets the retainer maintains its rigidity, and this could still deform soft aluminium wires (like, but not limited to, the grade AWS 4043) in the commonly used thin wire diameters like for example 1.20 mm.

Again Carroscia in U.S. Pat. No. 7,410,111 describes, as a possible solution, the cut out of entire retainer sections in order to decrease the retainer plate weight by as much as 50% of its overall weight. This plate however is rigid and it can still deform the wire during payout; additionally this particular embodiment comes with the risk that the wire coil under the retainer can become excessively exposed to air contamination and oxydation.

Edelmann and Zoller in EP 2 354 039 also try to address the problem of the possible impact of a heavy retainer on the wire coil and disclose a retainer exerting a contact pressure on the wire spool for maintaining the spirals of the spool which is between 10 and 25 $N/m^2$. This retainer with a claimed thickness of up to 15 mm has a significant degree of rigidity.

Gelmetti and Fagnani in EP 2 168 706 propose a flexible rubber retainer to smoothly control the wire payout but their retainer is quite expensive to build as it requires an outer periferical support frame and it is not designed to control aluminium welding wire since it features a plurality of flexible flaps which are freely hanging and pushed downwardly by the force of gravity into the middle of the pack. A soft aluminium wire would have to overcome the resistance of these flaps to be paid out, and that would also inevitably contribute to cause wire deformation. The flaps, in this invention, seem to be aimed at preventing possible tangles caused by the simultaneous feeding of multiple wire strands.

While the first two prior art documents are expressly directed to resolve the problem of the wire deformation, the latter two attempt to rather address the issue of wire tangling during payout from the bulk container.

Gelmetti in U.S. patent application Ser. No. 13/330,314 and International Patent Application PCT/EP2012/076081 teaches of a dynamic retainer to pay wires out of a bulk container such retainer being composed by the assembly of several individual "tiles" connected together but independently raising at the passage of wire. Notwithstanding the dynamic interaction of this retainer with the wire the tiles are rigid pieces and testing has demonstrated that deformation of softer aluminium wires can in fact still occur.

There is a need for a retainer which allows a smooth pay-out of soft, deformable welding wire such as aluminum welding wire.

BRIEF DESCRIPTION OF THE INVENTION

The invention provides a retainer for exerting a braking effect on wire provided as a spool in a container. The retainer has a plate-like elastic element with a contact surface adapted for resting on the wire, an outer circumference adapted for being guided in the container, and an inner circumference adapted for allowing the wire to pass through. The plate-like elastic element has an elasticity such that one of the inner and outer circumferences sags down, under the proper weight of the retainer, by a distance of at least 10 mm when the retainer is supported at the other of the inner and outer circumference. The invention is based on the recognition that a comparatively elastic retainer is particularly suitable for controlling pay-out of the welding wire as it on the one hand allows the wire to lift the retainer at the inner circumference, thereby locally adapting the shape and curvature of the retainer to the shape of the welding wire in the portion which is currently withdrawn from the upper surface of the welding wire coil, and on the other hand ensures that the remainder of the retainer remains flat on the upper surface of the wire coil, thereby exerting its braking effect on the upper windings of the welding wire coil.

Preferably, the distance by which the inner or outer circumference sags down is at least 20 mm and not more than 50 mm.

The invention also provides a retainer for exerting a braking effect on wire provided as a spool in a container, which has a plate-like elastic element with a contact surface adapted for resting on the wire, an outer circumference adapted for being guided in the container, and an inner circumference adapted for allowing the wire to pass through. The plate-like elastic element has an elasticity such that when the retainer is supported along a diameter, opposite sides of the retainer sag down, under the proper weight of the retainer, by a distance which is more than 5% of said diameter of the retainer. The elasticity which allows this deformation of the retainer also allows controlling pay-out of the welding wire in an advantageous manner as it on the one hand allows the wire to lift the retainer at the inner circumference, thereby locally adapting the shape and curvature of the retainer to the shape of the welding wire in the portion which is currently withdrawn from the upper surface of the welding wire coil, and on the other hand ensures that the remainder of the retainer remains flat on the upper surface of the wire coil, thereby exerting its braking effect on the upper windings of the welding wire coil.

Preferably, the distance by which opposite sides of the retainer sag downwardly when the retainer is being supported centrally along a diameter is at least 10% of the diameter of the retainer and more preferably 15% of the diameter.

In order to ensure that the retainer has a strength and rigidity which prevents the retainer from collapsing and falling into the interior of the welding wire coil, the distance by which opposite sides of the retainer sag downwardly when the retainer is being supported centrally along a diameter is not more than 40% of the diameter of the retainer.

Preferably, the plate-like elastic element consists of plastic. This allows manufacturing the retainer at low costs with the desired elasticity.

Polycarbonate is particularly advantageous as its properties, in particular the elasticity, can easily be controlled to be within desired values.

According to a preferred embodiment of the invention, the retainer is transparent. This allows visually checking the welding wire coil which is being covered by the retainer.

The plate-like elastic element of the retainer preferably has a thickness which is in a range of 0.3 mm to 12 mm. These values allow combining the desired elasticity with a low weight and a sufficient rigidity.

According to an embodiment of the invention, the plate-like elastic element of the retainer is provided with a reinforcement ring which extends along said outer circumference. This allows using a very pliant and yielding plate-like elastic element, e.g. a rubber sheet, which is being conferred the necessary rigidity for staying on top of the welding wire coil by the frame-like reinforcement ring.

Preferably, the retainer has a contact surface with a roughness which is different from a roughness of a surface which is opposite the contact surface. In other words, the two surfaces of the plate-like elastic element are manufactured with different surface roughnesses. If a higher braking effect of the retainer is desired, the retainer is employed such that the surface with the higher roughness acts as the contact surface. If a lower braking effect is desired, the retainer is reversed and the smoother surface is being used as contact surface. The different roughnesses can be achieved by molding the plate-like elastic element in a mould which has a polished and a non-polished or even roughened surface, or by a suitable surface treatment of the plate-like elastic element of the retainer.

The invention also provides a welding wire container having a bottom, circumferential walls extending upwardly from the bottom, a welding wire coil formed from a plurality of windings of welding wire, and a retainer which rests on an upper surface of the coil. The retainer has a plate-like elastic element with a contact surface adapted for resting on the wire, an outer circumference adapted for being guided in the container, and an inner circumference adapted for allowing the wire to pass through. The plate-like elastic element has an elasticity E which is in a range of 0.05 to 0.4, with the elasticity E being determined by the following formula:

$$E = \frac{0.2\%\ yieldlimit}{specificweight * B}$$

with:

the 0.2% yield limit of the welding wire in $N/mm^2$;

the specific weight of the welding wire in $g/cm^3$;

B being the widths of the retainer from the inner to the outer circumference in mm;

Preferably, the elasticity E as determined by the above formula is within a range of 0.08 to 0.14.

BRIEF DESCRIPTION OF THE DRAWINGS

The invention will now be described with reference to the enclosed drawings. In the drawings.

DETAILED DESCRIPTION OF THE INVENTION

Figure 1:
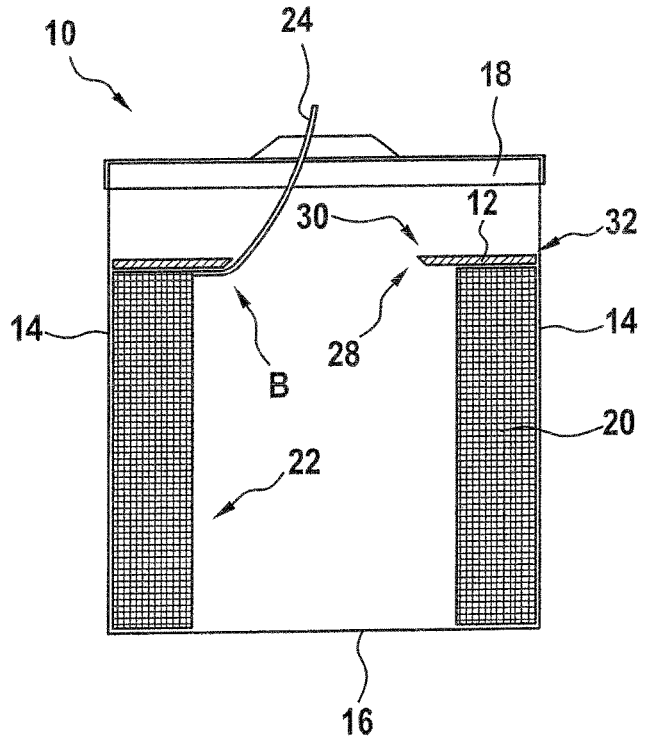
Fig. 1 PRIOR ART
FIG. 1 shows a prior art container with retainer in a cross section.
Figure 2:
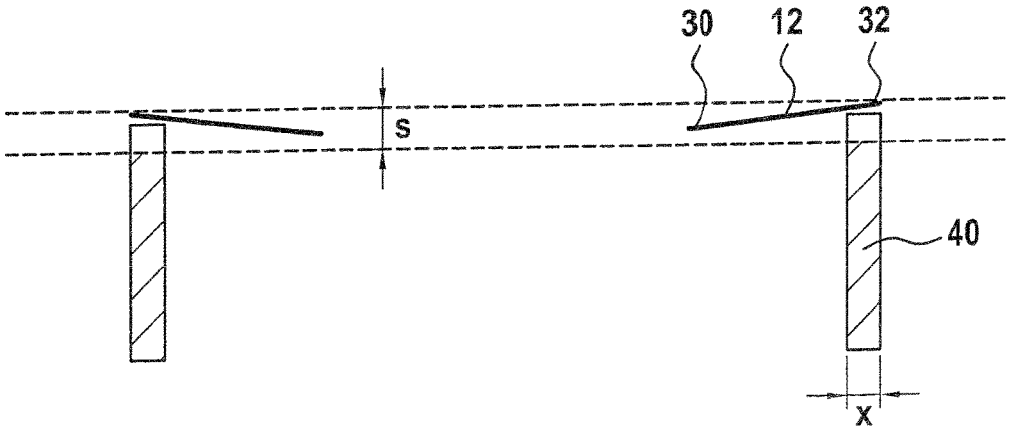
Fig. 2 PRIOR ART
FIG. 2 shows the elastic behavior of the prior art retainer when tested in a first type of set-up.

A welding wire container 10 with a welding wire retainer 12 as known from the prior art is shown in FIGS. 1 and 2. The container 10 has a rectangular inner cross section (e.g. octagonal), side walls 14 (two side walls are shown), a bottom 16 and a lid 18.

In the interior of the container 10, a welding wire coil 20 is accommodated. The welding wire coil 20 consists of a certain amount of welding wire 22 which is coiled so as to form a hollow body with a ring-shaped cross section. The portion of the welding wire which is currently being withdrawn from the container is designated with reference numeral 24.

On the upper side of the welding wire coil 20, the retainer 12 is provided. The retainer 12 has a plate-like body with a central opening 28 which is delimited by an inner circumference 30. An outer circumference 32 of retainer 12 serves for guiding the retainer within the container, in particular between the side walls 14.

The retainer 12 lies on the upper side of the welding wire coil 20, the retainer 12 being always generally parallel to lid 18.

Conventional prior art retainers are made from a thick plastic element which is generally rigid. This will be explained with reference to FIG. 2. If the retainer as used in the container of FIG. 1 is supported along its outer circumference 32 by means of a support 40 which follows the outer contour of retainer 12 and has a small width x (e.g. not more than 10 mm), then the inner circumference 30 of the prior art retainer 12 sags downwardly by a distance s which is not more than 10 mm. This is due to the fact that the plate-like retainer is essentially rigid.

The result of retainer 12 being rigid can be seen in FIG. 1.

Retainer 12 exerts, owing to its weight and the friction between the retainer 12 and the welding wire 24, a braking effect on the welding wire 24 when the welding wire is withdrawn from container 10. This braking effect results in a certain traction force which is necessary for pulling the wire from the coil 20. The traction force however results in the welding wire 24 being bent in a region B where it passes around the inner circumference 30 of retainer 12.

In order to avoid the welding wire 24 from being bent when passing around the inner circumference 30 of retainer 12, the invention provides a retainer 12 which is elastic. A first embodiment of the retainer is shown in FIG. 3, where the same reference numerals are being used as in FIG. 1.

Retainer 12 is as a plate-like elastic element which can simply be cut out from a thin sheet made of elastic material. As elastic material, plastic with the necessary elasticity is preferred, in particular polycarbonate. The inherent elasticity of the plate-like elastic element allows deforming the plate-like element which however returns to its original position as soon as the pressure is released.

Figure 3:
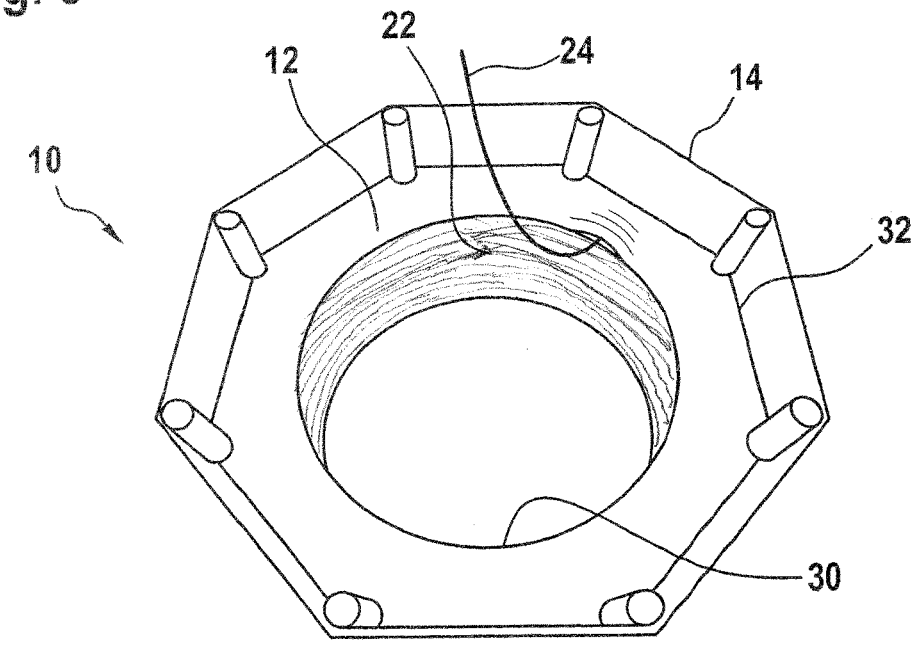
FIG. 3 shows a perspective view of a container according to the invention with a retainer according to a first embodiment of the invention.

The behavior of the retainer can be seen in FIG. 3. Retainer 12 bends and deforms only at the very point (and closely adjacent thereto) where it is engaged by the wire 24 being paid out while the remaining portion of retainer 12, not engaged, remains still and undeformed to control the remaining strands and the rest of the wire coil 20.

As soon as the wire 24 has passed the engaged point of plate-like elastic element 13, the deformed portion returns to its original undeformed condition. This provides a dynamic controlling action that actively follows the movement of the wire strand being paid out, adapting itself to the wire 24 without deforming it.

It can be seen that due to the particular elasticity of the plate-like elastic element which forms retainer 12, the inner contour of the retainer adjacent inner circumference 30 is deformed by the wire such that the retainer is locally curved upwardly, thereby preventing any sharp bending of the welding wire.

Figure 4:
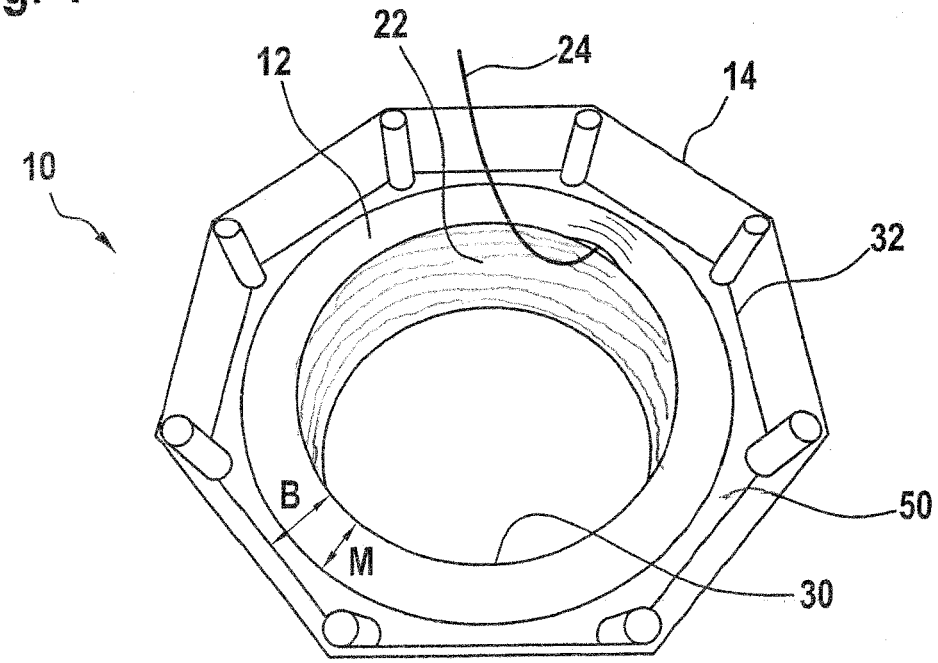
FIG. 4 shows a perspective view of a container according to the invention with a retainer according to a second embodiment of the invention.

A second embodiment of the retainer is shown in FIG. 4. The difference between the first and second embodiment is that the second embodiment uses a reinforcement ring 50 which defines the outer contour of retainer 12. The majority M of the width B of the annular retainer 12 is however not covered by reinforcement ring 50 so that the plate-like elastic element is exposed. The advantage of the second embodiment over the first embodiment is that a very thin and thereby flexible plate-like elastic element can be used with the second embodiment without there being any risk that the stability and rigidity of the entire retainer 12 is not sufficient for securely keeping it on top of the welding wire coil. The plate-like elastic element can here be formed of a very thin, flexible material like rubber or silicon, with the reinforcement ring 50 acting as a rigid, supportive frame.

For both embodiments, the outer contour of retainer 12, defined by outer circumference 32, matches the contour of the inside of container 10, with a slight play being provided between the inner contour of the container 10 and the outer contour of the retainer 12. This play allows retainer 12 to freely descend in the interior of container 10 when the height of the welding wire coil 20 decreases.

Further, the diameter of the opening 28 defined by the inner circumference 30 of the retainer 12 is slightly smaller than the inner diameter of welding wire coil 20 so that no area of the top of the wire coil 20 is exposed to air contamination. In other words, the retainer plate completely covers the top side of the coil.

The inner contour 30 of plate-like elastic element 12 has a uniform, uninterrupted edge, without there being any additional flaps, fingers or dents.

The optimal thickness to obtain a sufficient level of elasticity of the retainer varies and is in relation with the dimensions of the retainer itself: the larger the plate, the thicker it must be, and vice versa. In general, the elasticity of the retainer must not be excessively high as this could result in a deformation of the entire retainer such that it drops into the interior of the welding wire coil, resulting in a jamming of the whole system. At the same time, the elasticity of the retainer must be sufficient for allowing the plate-like elastic element to yield under the traction forces acting on the welding wire such that the welding wire is not deformed.

Figure 5:
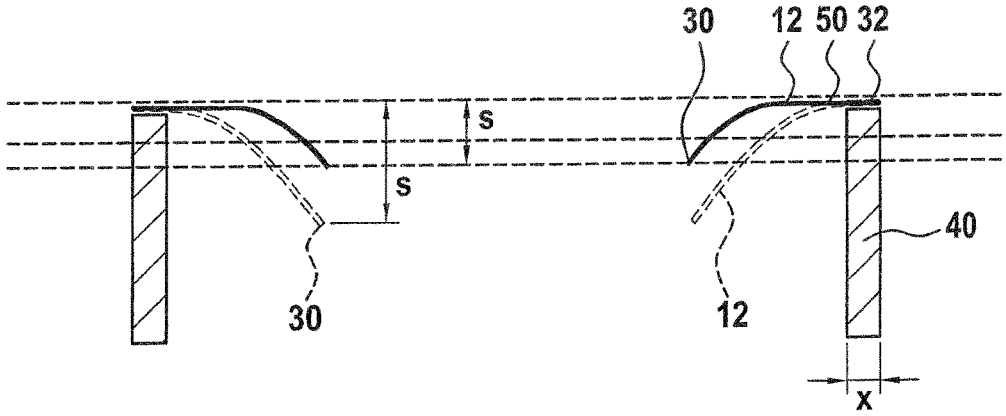
FIG. 5 shows the first type of set-up for determining the appropriate elasticity of a retainer according to the invention, and two embodiments of the retainer according to the invention.

The suitable elasticity of the retainer can very easily be determined with the set-up as shown in FIG. 5. The set-up is the same as already shown in FIG. 2, namely a support 40 which is narrow (with a thickness x of no more than 10 mm) and which supports the outer circumference 32 of the retainer.

The retainer 12 as shown in FIG. 4 is shown in continuous lines in FIG. 5. It can be seen that the outer circumference 32 remains basically undeformed due to reinforcement ring 50. The inner circumference 30 sags down by a distance s which is at least 10 mm and preferably at least 20 mm.

The retainer of FIG. 3 is shown in dashed lines. Here again, the inner circumference 30 sags down by a distance s which is at least 10 mm and preferably at least 20 mm. Owing to the desired stability of the retainer, the inner circumference 30 of retainer 12 will not sag down more than 50 mm.

A retainer 12 according to the invention will exhibit the same behavior if the set-up is reversed such that it supports the retainer along the inner circumference 30 rather than along the outer circumference 32.

Figure 6:
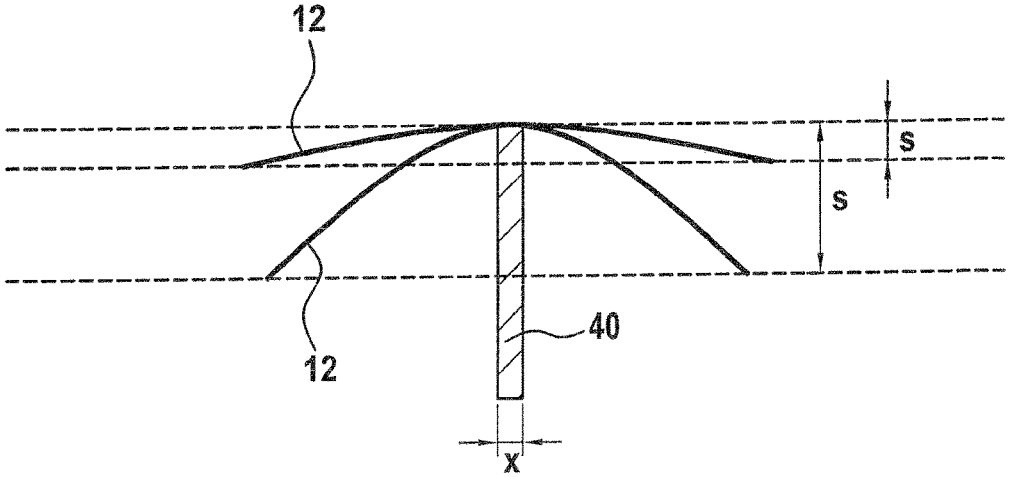
FIG. 6 shows a second type of set-up for determining the appropriate elasticity of a retainer according to the invention.

A different set up for choosing the correct elasticity of retainer 12 is shown in FIG. 6. Here, a narrow support (again having a width x of not more than 10 mm) is used which supports the retainer centrally along a diameter. A conventional, rigid retainer will, when supported by a narrow support 50 which extends along a diameter of the retainer, deform under its proper weight such that opposite sides sag down by a distance s which is not more than 5% of the diameter of the retainer. An inventive retainer 12 will show a larger deformation. Opposite ends of a retainer 12 according to the invention will sag down by a distance s which is more than 5% of the diameter of the retainer, in particular more than 15%. In order to guarantee a sufficient proper stability of the retainer, the elasticity is chosen such that opposite sides of the retainer do not sag down more than 40% of the diameter of the retainer.

It has been determined that the 0.2% yield limit of the welding wire in the container and also the specific weight of the welding wire are decisive factors for determining a suitable elasticity of retainer 12. Taking further into account the dimensions of the retainer, it has been found out that an elasticity factor E can be determined with the following formula:

$$E = \frac{0.2\%\ yieldlimit}{specificweight * B}$$

with:

the 0.2% yield limit of the welding wire in $N/mm^2$;

the specific weight of the welding wire in $g/cm^3$;

B being the widths of the retainer from said inner to said outer circumference in mm;

The best results were achieved with an elasticity E in a range of 0.05 to 0.4, in particular well within the range of 0.08 to 0.14.

If a transparent material like thin polycarbonate is used to produce the retainer, it is also possible to visually inspect the complete wire movements and layers behavior.

It also possible to use, for cutting the retainer out, plastic sheets which have a polished and therefore more slippery surface on one side and a milled and therefore rougher surface on the opposite side, so that the retainer can conveniently be turned upside down as needed, in order to increase or decrease the retainer strands controlling action, for example depending on the wire diameter, the wire hardness or the wire surface finish.

The invention claimed is:

1. A container having a bottom, and circumferential walls extending upwardly from said bottom, containing a coil of welding wire formed of a plurality of windings of welding wire contained in the welding wire container, and an internal retainer positioned on the coil of wire for exerting a braking effect on the wire stored in the container as the wire is withdrawn from the container, said retainer comprising a ring-shaped elastic element formed of a non-magnetic material having a contact surface in part supported on said coil of wire, and a surface opposite said contact surface said ring-shaped elastic element having an outer circumference adapted for being guided in said container, and an inner circumference having a uniform uninterrupted edge adapted for allowing said wire to pass through, said ring-shaped elastic element having physical characteristics of a thickness in a range of 0.3 mm to 12 mm, and being formed of a plastic material having a flexibility such that when an outer 10 mm circumference of said ring-shaped elastic element is supported, unsupported regions of said ring-shaped elastic element sag down, under their own weight, by a distance of at least 10 mm and not more than 50 mm, whereby a controlled braking effect of pay-out of the welding wire from the container results due solely to the weight of and friction of the retainer acting on the wire.

2. The container of claim 1 wherein said distance is at least 20 mm.

3. The container of claim 1 wherein said ring-shaped elastic element is formed of polycarbonate.

4. The container of claim 1 wherein said retainer is transparent.

5. The container of claim 1 wherein said ring-shaped elastic element is provided with a reinforcement ring which extends along said outer circumference.

6. The container of claim 1 wherein said contact surface has a roughness which is different from a roughness of a surface which is opposite said contact surface.

7. A container having a bottom, and circumferential walls extending upwardly from said bottom, containing a coil of welding wire formed of a plurality of windings of welding wire contained in the welding wire container, and an internal retainer positioned on the coil of wire for exerting a braking effect on the wire stored in the container as the wire is withdrawn from the container, said retainer having a ring-shaped elastic element formed of a non-magnetic material having a contact surface in part supported on said coil of wire, and a surface opposite said surface, said ring-shaped elastic element having an outer circumference adapted for being guided in said container, and an inner circumference having a uniform uninterrupted edge adapted for allowing said wire to pass through, said ring-shaped elastic element having a thickness in a range of 0.3 mm to 12 mm, and being formed of a plastic material having physical characteristics of a flexibility such that when the retainer is supported centrally by a 10 mm wide support, unsupported regions of said ring-shaped elastic element sag down, under their own weight, by a distance which is between 5% and 40% of said diameter of said retainer, whereby a controlled braking effect of pay-out of the welding wire from the container results due solely to the weight of and friction of the retainer acting on the wire.

8. The container of claim 7 wherein said distance is at least 10% of said diameter.

9. The container of claim 8 wherein said distance is at least 15% of said diameter.

10. The container of claim 7 wherein said distance is not more than 40% of said diameter.

11. The container of claim 7 wherein said ring-shaped elastic element is provided with a reinforcement ring which extends along said outer circumference.

12. The container of claim 7 wherein said contact surface has a roughness which is different from a roughness of a surface which is opposite said contact surface.

13. A container having a bottom, and circumferential walls extending upwardly from said bottom, containing a welding wire coil formed from a plurality of windings of welding wire contained in the welding wire container, and an internal retainer which rests on an upper surface of said coil, said retainer having a ring-shaped elastic element formed of non-magnetic material having a contact surface in part resting on said coil of wire, and a surface opposite said contact surface, said retainer having an outer circumference adapted for being guided in said container, and an inner circumference having a uniform uninterrupted edge adapted for allowing said wire to pass through, said ring-shaped elastic element being formed of a plastic material having physical characteristics of a thickness in a range of 0.3 mm to 12 mm, flexibility E selected based on a yield limit and a specific weight of the wire, and a width of the retainer, wherein the flexibility E is determined by the following formula:

$$E = \frac{0.2\%\ \text{yield limit}}{\text{specific weight} * B}$$

wherein:

the 0.2% yield limit of the welding wire is in $N/mm^2$;

the specific weight of the welding wire is in $g/cm^3$;

B is the width of the retainer from said inner to said outer circumference in mm, such that unsupported regions of said retainer sag down, under their own weight whereby a controlled braking effect on pay-out of said wire as the wire is withdrawn from the container results solely due to the weight and friction of the retainer acting on the wire.

14. The container of claim 13 wherein said elastic flexibility E is within a range 0.08 to 0.14.

15. The container of claim 13 wherein said ring-shaped elastic element is formed of polycarbonate.

16. The container of claim 13 wherein said retainer is transparent.

* * * * *